US011189208B2

(12) United States Patent
Shi et al.

(10) Patent No.: US 11,189,208 B2
(45) Date of Patent: Nov. 30, 2021

(54) DRIVING METHOD FOR PIXEL ARRAY, DRIVING CIRCUIT, AND DISPLAY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Tiankuo Shi, Beijing (CN); Xiaomang Zhang, Beijing (CN); Bin Dai, Beijing (CN); Lingyun Shi, Beijing (CN); Wei Sun, Beijing (CN); Bo Gao, Beijing (CN); Yue Li, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 502 days.

(21) Appl. No.: 16/081,638

(22) PCT Filed: Dec. 15, 2017

(86) PCT No.: PCT/CN2017/116566

§ 371 (c)(1),
(2) Date: Aug. 31, 2018

(87) PCT Pub. No.: WO2018/161676

PCT Pub. Date: Sep. 13, 2018

(65) Prior Publication Data

US 2021/0183295 A1 Jun. 17, 2021

(30) Foreign Application Priority Data

Mar. 7, 2017 (CN) ..... 201710132395.4

(51) Int. Cl.
*G09G 3/20* (2006.01)

(52) U.S. Cl.
CPC ..... *G09G 3/2003* (2013.01); *G09G 3/20* (2013.01); *G09G 2300/0452* (2013.01); *G09G 2310/027* (2013.01)

(58) Field of Classification Search
CPC .. G09G 3/2003; G09G 3/3233; G09G 3/3258; G09G 3/3291; G09G 3/3607;
(Continued)

(56) References Cited

U.S. PATENT DOCUMENTS 9,613,564 B2 * 4/2017 Liu ..... G09G 3/20
9,734,749 B2 * 8/2017 Hwang ..... G09G 3/2074
(Continued)

FOREIGN PATENT DOCUMENTS

CN 101364384 A 2/2009
CN 103106893 A 5/2013
(Continued)

OTHER PUBLICATIONS

The Second Office Action dated Mar. 19, 2019 corresponding to Chinese application No. 201710132395.4.
(Continued)

*Primary Examiner* — Vijay Shankar
(74) *Attorney, Agent, or Firm* — Nath, Goldberg & Meyer; Joshua B. Goldberg

(57) ABSTRACT

A driving method for a pixel array is provided. The driving method includes: amplifying an input image to obtain an intermediate image; calculating display parameters of each actual pixel unit based on display parameters of the intermediate theoretical pixel units of the intermediate image; and generating actual image signals based on the calculated display parameters of each actual pixel unit and inputting the actual image signals to the actual pixel units of the pixel array, respectively.

18 Claims, 3 Drawing Sheets

(58) Field of Classification Search
CPC .. G09G 3/3611; G09G 3/3648; G09G 3/3688; G09G 2310/027; G09G 2300/0452
See application file for complete search history.

(56) References Cited

U.S. PATENT DOCUMENTS

| | | | | |
|---|---|---|---|---|
| 10,192,286 | B2 * | 1/2019 | Furihata | G06T 3/403 |
| 10,783,849 | B2 * | 9/2020 | Ishida | G09G 3/3688 |
| 2016/0078599 | A1 * | 3/2016 | Furihata | G06T 3/4007 345/667 |
| 2016/0180765 | A1 | 6/2016 | Hwang et al. | |
| 2016/0275856 | A1 | 9/2016 | Liu et al. | |
| 2019/0043440 | A1 * | 2/2019 | Ishida | G09G 3/3688 |

FOREIGN PATENT DOCUMENTS

| | | | |
|---|---|---|---|
| CN | 103177420 | A | 6/2013 |
| CN | 103366342 | A | 10/2013 |
| CN | 103888706 | A | 6/2014 |
| CN | 105427817 | A | 3/2016 |
| CN | 105551455 | A | 5/2016 |
| CN | 106652969 | A | 5/2017 |
| JP | 200099713 | A | 4/2000 |

OTHER PUBLICATIONS

First Office Action dated Jul. 4, 2018 corresponding to Chinese application No. 201710132395.4.
International Search Report dated Mar. 15, 2018 corresponding to application No. PCT/CN2017/116566.

* cited by examiner

DRIVING METHOD FOR PIXEL ARRAY, DRIVING CIRCUIT, AND DISPLAY DEVICE

CROSS-REFERENCE TO RELATED APPLICATION

This is a National Phase Application filed under 35 U.S.C. 371 as a national stage of PCT/CN2017/116566, filed Dec. 15, 2017, an application claiming priority to Chinese Patent Application No. 201710132395.4 filed on Mar. 7, 2017, the contents of which are incorporated by reference in the entirety.

TECHNICAL FIELD

The present disclosure relates to a driving method for pixel array, a driving circuit, and a display device.

BACKGROUND

With the development of display technologies, there is a higher and higher demand on image quality of display devices by consumers, which requires the display devices to display fine images with higher resolution.

However, a higher resolution of the display device means a greater amount of information of an input image, thereby reducing the speed of data transmission.

Therefore, how to display a amplified image on a high-resolution display screen and increase the data transmission speed while obtaining a high-resolution display effect has become a technical problem to be solved urgently in the field.

SUMMARY

A driving method for a pixel array including a plurality of actual pixel units is provided in the present disclosure, the driving method including:

amplifying an input image to obtain an intermediate image, wherein the input image includes a plurality of initial theoretical pixel units, the intermediate image includes a plurality of intermediate theoretical pixel units, and the number of the intermediate theoretical pixel units of the intermediate image matches the number of the actual pixel units in the pixel array;

calculating display parameters of each actual pixel unit based on display parameters of the intermediate theoretical pixel units of the intermediate image; and generating actual image signals based on the calculated display parameters of each actual pixel unit and inputting the actual image signals to the actual pixel units of the pixel array, respectively.

Optionally, amplifying the input image includes longitudinally amplifying the input image by a factor of two.

Optionally, display parameters of each initial theoretical pixel unit includes a first initial display component, a second initial display component and a third initial display component, display parameters of each intermediate theoretical pixel unit includes a first intermediate display component, a second intermediate display component and a third intermediate display component, in step stp1, when $0<n<M-1$, the process of amplifying the input image is performed according to the following equations;

$$d_{(2n-1)i}=\alpha D_{ni}+\beta D_{(n+1)i};$$

$$e_{(2n-1)i}=\alpha E_{ni}+\beta E_{(n+1)i};$$

$$f_{(2n-1)i}=\alpha F_{ni}+\beta F_{(n+1)i};$$

$$d_{(2n)i}=\eta D_{ni}+\gamma D_{(n+1)i};$$

$$e_{(2n)i}=\eta E_{ni}+\gamma E_{(n+1)i};$$

$$f_{(2n)i}=\eta F_{ni}+\gamma F_{(n+1)i};$$

wherein $d_{(2n-1)i}$ is a value of a first intermediate display component of the intermediate theoretical pixel unit in row (2n−1) and column i;

$e_{(2n-1)i}$ is a value of a second intermediate display component of the intermediate theoretical pixel unit in row (2n−1) and column i;

$f_{(2n-1)i}$ is a value of a third intermediate display component of the intermediate theoretical pixel unit in row (2n−1) and column i;

$d_{(2n)i}$ is a value of a first intermediate display component of the intermediate theoretical pixel unit in row 2n and column i;

$e_{(2n)i}$ is a value of a second intermediate display component of the intermediate theoretical pixel unit in row 2n and column i;

$f_{(2n)i}$ is a value of a third intermediate display component of the intermediate theoretical pixel unit in row 2n and column i;

$D_{ni}$ is a value of a first initial display component of the initial theoretical pixel unit in row n and column i;

$E_{ni}$ is a value of a second initial display component of the initial theoretical pixel unit in row n and column i;

$F_{ni}$ is a value of a third initial display component of the initial theoretical pixel unit in row n and column i;

$D_{(n+1)i}$ is a value of a first initial display component of the initial theoretical pixel unit in row (n+1) and column i;

$E_{(n+1)i}$ is a value of a second initial display component of the initial theoretical pixel unit in row (n+1) and column i;

$F_{(n+1)i}$ is a value of a third initial display component of the initial theoretical pixel unit in row (n+1) and column i;

α, β, η, γ are all adjustment coefficients, wherein $\alpha+\beta=1$, $\eta+\gamma=1$, $0\leqslant\alpha\leqslant1$, $0\leqslant\beta\leqslant1$, $0\leqslant\eta\leqslant1$, $0\leqslant\gamma\leqslant1$;

n is a natural number; and

M is a total number of rows of intermediate theoretical pixel units of the intermediate image.

Optionally, when n=M−1, M, the process of amplifying the input image is performed according to the following equations;

$$d_{(2n-1)i}=\alpha D_{ni}+\beta D_{ni};$$

$$e_{(2n-1)i}=\alpha E_{ni}+\beta E_{ni};$$

$$f_{(2n-1)i}=\alpha F_{ni}+\beta F_{ni};$$

$$d_{(2n)i}=\eta D_{ni}+\gamma D_{ni};$$

$$e_{(2n)i}=\eta E_{ni}+\gamma E_{ni};$$

$$f_{(2n)i}=\eta F_{ni}+\gamma F_{ni}.$$

Optionally, display parameters of the last two rows of intermediate theoretical pixel units of the intermediate image are set to be the same as display parameters of the last two rows of initial theoretical pixel units in the input image.

Optionally, each of the initial theoretical pixel units includes a red initial theoretical sub-pixel, a green initial theoretical sub-pixel, and a blue initial theoretical sub-pixel, and the first initial display component includes a grayscale value of the red initial theoretical sub-pixel, the second initial display component includes a grayscale value of the green initial theoretical sub-pixel, and the third initial display component includes a grayscale value of the blue initial theoretical sub-pixel; and each of the intermediate theoretical pixel units includes a red intermediate theoretical sub-pixel, a green intermediate theoretical sub-pixel, and a blue intermediate theoretical sub-pixel, and the first intermediate display component includes a gray-scale value of the red intermediate theoretical sub-pixel, and the second intermediate display component includes a gray value of the green intermediate theoretical sub-pixel, and the third intermediate display component includes a gray value of the blue intermediate theoretical sub-pixel.

Optionally, the first initial display component includes an initial lumen component of each of the initial theoretical pixel units, the second initial display component includes an initial blue-difference chroma component of the initial theoretical pixel unit, and the third initial display component includes an initial red-difference chroma component of the initial theoretical pixel unit; and the first intermediate display component includes an intermediate lumen component of each of the intermediate theoretical pixel units, the second intermediate display component includes an intermediate blue-difference chroma component of the intermediate theoretical pixel unit, and the third intermediate display component includes an intermediate red-difference chroma component of the intermediate theoretical pixel unit.

Optionally, amplifying the input image to obtain an intermediate image includes:

calculating the first initial display component, the second initial display component, and the third initial display component of each initial theoretical pixel unit in the input image;

calculating the first intermediate display component, the second intermediate display component, and the third intermediate display component of each intermediate theoretical pixel unit of the intermediate image based on the first initial display component, the second initial display component, and the third initial display component of each initial theoretical pixel unit; and calculating a grayscale value of a red intermediate theoretical sub-pixel of each intermediate theoretical pixel unit, a grayscale value of a green intermediate theoretical sub-pixel of each intermediate theoretical pixel unit, and a grayscale value of a blue intermediate theoretical sub-pixel of each intermediate theoretical pixel unit based on the first intermediate display component, the second intermediate display component and the third intermediate display component of each intermediate theoretical pixel unit.

Optionally, an arrangement of the actual pixel units of the pixel array is the same as that of the intermediate theoretical pixel units of the intermediate image.

Optionally, the actual pixel units each include a plurality of actual sub-pixels, and a number of the actual sub-pixels is the same as that of the intermediate theoretical sub-pixels in the intermediate image, and in the pixel array, an arrangement of the actual sub-pixels in one of an odd-numbered row of actual pixel units and an even-numbered row of actual pixel units is the same as that of the intermediate theoretical sub-pixels in a corresponding row of intermediate theoretical pixel units in the intermediate image, and the arrangement of the actual sub-pixels in one of the odd-numbered row of actual pixel units and the even-numbered row of actual pixel units is offset from the arrangement of the other one of the odd-numbered row of actual pixel units and the even-numbered row of actual pixel units by a predetermined distance along a row direction, and the actual pixel units in the odd-numbered rows are aligned with each other, and the actual pixel units in the even-numbered rows are aligned with each other.

Optionally, the predetermined distance is a half of a width of each actual sub-pixel along the row direction.

Optionally, in the pixel array, each of the actual pixel units includes a red actual sub-pixel, a green actual sub-pixel, and a blue actual sub-pixel, wherein display parameters of each of the actual pixel units includes a first actual display component, a second display component and a third display component;

the arrangement of the actual sub-pixels in the odd-numbered row of actual pixel units is the same as that of the intermediate theoretical sub-pixels in the corresponding row of intermediate theoretical pixel units in the intermediate image, and the actual sub-pixels in the odd-numbered row of actual pixel units are arranged in the order of a red actual sub-pixel, a green actual sub-pixel, and a blue actual sub-pixel;

the actual sub-pixels in the even-numbered row of actual pixel units are arranged in the order of a blue actual sub-pixel, a red actual sub-pixel, and a green actual sub-pixel;

when $1<j<J$, calculating display parameters of each actual pixel unit based on display parameters of the intermediate theoretical pixel units of the intermediate image includes:

taking display parameters of the odd-numbered row of intermediate theoretical pixel units in the intermediate image as display parameters of the odd-numbered row of actual pixel units in the pixel array;

calculating display parameters of the even-numbered row of actual pixel units according to the following equations:

$$D'_{aj}=[d_{(a-1)j}+d_{(a-1)(j+1)}]/2;$$

$$E'_{aj}=[e_{a(j-1)}+e_{aj}]/2;$$

$$F'_{aj}=[f_{a(j-1)}+f_{aj}]/2;$$

wherein $D'_{aj}$ is a first actual display component of the actual pixel unit in row a and column j;

$E'_{aj}$ is a second actual display component of the actual pixel unit in row a and column j;

$F'_{aj}$ is a third actual display component of the actual pixel unit in row a and column j;

$d_{(a-1)j}$ is a first display parameter of the intermediate theoretical sub-pixel in row a−1 and column j;

$d_{(a-1)(j-1)}$ is a first intermediate display component of the intermediate theoretical pixel unit in row a−1 and column j+1;

$e_{a(j-1)}$ is a second intermediate display component of the intermediate theoretical pixel unit in row a and column j−1;

$e_{aj}$ is a second intermediate display component of the intermediate theoretical pixel unit in row a and column j;

$f_{a(j-1)}$ is a third intermediate display component of the intermediate theoretical pixel unit in row a and column j−1;

$f_{aj}$ is a third intermediate display component of the intermediate theoretical pixel unit in row a and column j;

a is an even number; and j is natural number, and $1<j<J$, J is a number of actual pixel units in each row of actual pixel units.

Optionally, calculating display parameters of each actual pixel unit based on display parameters of the intermediate theoretical pixel units of the intermediate image includes:

calculating display parameters of the first actual pixel unit of the even-numbered row according to the following equations:

$$D'_{a1}=[d_{(a-1)1}+d_{(a-1)2}]/2;$$

$$E'_{a1}=e_{a1};$$

$$F'_{a1}=[f_{(a-1)1}+f_{(a-1)2}]/2;$$

wherein $D'_{a1}$ is a first actual display component of the actual pixel unit in row a and column 1, $E'_{a1}$ is a second actual display component of the actual pixel unit in row a and column 1, $F'_{a1}$ is a third actual display component of the actual pixel unit in row a and column 1, $d_{(a-1)1}$ is a first intermediate display component of the intermediate theoretical pixel unit in row a−1 and column 1, $d_{(a-1)2}$ is a first intermediate display component of the intermediate theoretical pixel unit in row a−1 and column 2, $e_{a1}$ is a second intermediate display component of the intermediate theoretical pixel unit in row a and column 1, $f_{(a-1)1}$ is a third intermediate display component of the intermediate theoretical pixel unit in row a−1 and column 1, and $f_{(a-1)2}$ is a third intermediate display component of the intermediate theoretical pixel unit in row a−1 and column 2; and calculating display parameters of the last actual pixel unit of the even-numbered row according to the following equation:

$$D'_{aJ}=d_{aJ};$$

$$E'_{aJ}=[e_{a(J-1)}+e_{aJ}]/2;$$

$$F'_{aJ}=f_{aJ},$$

wherein $D'_{aJ}$ is a first actual display component of the actual pixel unit in row a and column J, $E'_{aJ}$ is a second actual display component of the actual pixel unit in row a and column J, $F'_{aJ}$ is a third actual display component of the actual pixel unit in row a and column J, $d_{aJ}$ is a first intermediate display component of the intermediate theoretical pixel unit in row a and column J, $e_{(a-1)J}$ is a second intermediate display component of the intermediate theoretical pixel unit in row a−1 and column J, $e_{aJ}$ is a second intermediate display component of the intermediate theoretical pixel unit in row a and column J, and $f_{aJ}$ is a third intermediate display component of the intermediate theoretical pixel unit in row a and column J.

Optionally, calculating display parameters of each actual pixel unit based on display parameters of the intermediate theoretical pixel units of the intermediate image includes: taking display parameters of the intermediate theoretical pixel units at both ends of the even-numbered row of the intermediate images as the actual display parameters of the actual pixel units at both ends of corresponding even-numbered row in the pixel array.

Optionally, amplifying the input image includes longitudinally amplifying the input image by a factor of two and horizontally amplifying the input image by a factor of two.

As a second aspect of the present disclosure, a driving circuit for driving a display panel is provided, the display panel including a pixel array, the pixel array including a plurality of actual pixel units, each actual pixel unit including a plurality of actual sub-pixels of different colors, the driving circuit including:

an amplifier configured to amplify an input image to obtain an intermediate image, wherein the input image includes a plurality of initial theoretical pixel units, the intermediate image includes a plurality of intermediate theoretical pixel units, and a number of the intermediate theoretical pixel units of the intermediate image matches a number of the actual pixel units in the pixel array;

an actual luminance calculator configured to calculate display parameters of each actual pixel unit based on display parameters of the intermediate theoretical pixel units of the intermediate image;

a display driver connected with an input terminal of the pixel array and configured to generate actual image signals based on the display parameters of each actual pixel unit calculated by the actual luminance calculator and input the actual image signals to the actual pixel units of the pixel array, respectively.

As a third aspect of the present disclosure, a display device including a display panel and a driving circuit is provided, wherein the driving circuit is the above-described driving circuit provided in the disclosure, the display panel includes a pixel array, and the pixel array includes a plurality of actual pixel units.

Optionally, the actual pixel units each include a plurality of actual sub-pixels, and a number of the actual sub-pixels is the same as that of the intermediate theoretical sub-pixels in the intermediate image, and in the pixel array, an arrangement of the actual sub-pixels in one of an odd-numbered row of actual pixel units and an even-numbered row of actual pixel units is the same as that of the intermediate theoretical sub-pixels in a corresponding row of the intermediate theoretical pixel units in the intermediate image, and the arrangement of the actual sub-pixels in one of the odd-numbered row of actual pixel units and the even-numbered row of actual pixel units is offset from the arrangement of the other one of the odd-numbered row of actual pixel units and the even-numbered row of actual pixel units by a predetermined distance along a row direction, and the actual pixel units in the odd-numbered rows are aligned with each other, and the actual pixel units in the even-numbered rows are aligned with each other.

Optionally, the predetermined distance is a half of a width of each actual sub-pixel along the row direction.

Optionally, in the pixel array, each of the actual pixel units includes a red actual sub-pixel, a green actual sub-pixel, and a blue actual sub-pixel;

the arrangement of the actual sub-pixels in the odd-numbered row of actual pixel units is the same as that of the intermediate theoretical sub-pixels in the corresponding row of intermediate theoretical pixel units in the intermediate image, and the actual sub-pixels in the odd-numbered row of actual pixel units are arranged in the order of a red actual sub-pixel, a green actual sub-pixel, and a blue actual sub-pixel; and the actual sub-pixels in the even-numbered row of actual pixel units are arranged in the order of a blue actual sub-pixel, a red actual sub-pixel, and a green actual sub-pixel.

BRIEF DESCRIPTION OF THE FIGURES

For better understanding of the present disclosure, the drawings which constitute a part of the specification are provided so as to illustrate the present disclosure in conjunction with the following specific embodiments, and are not intended to limit the scope of the present disclosure. In the drawings.

DETAILED DESCRIPTION

Specific embodiments of the present disclosure will be described in detail below in conjunction with the accompanying drawings. It is to be noted that the embodiments presented herein are for the purpose of illustration and description only, and are not intended to limit the scope of the present disclosure.

Figure 1:
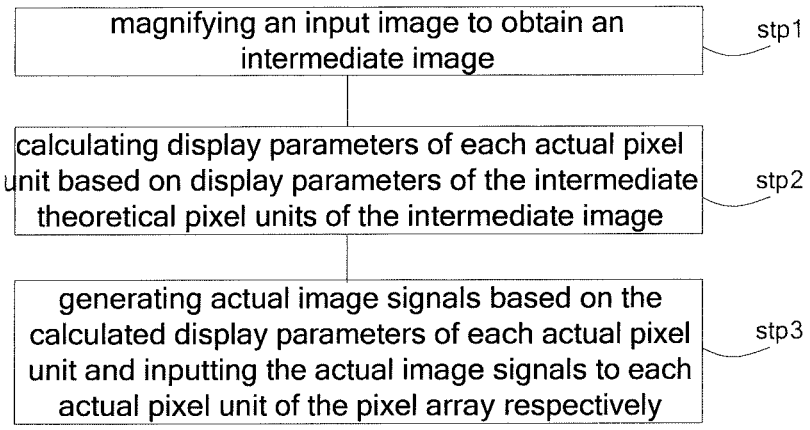
FIG. 1 is a schematic flowchart of a driving method provided in the present disclosure.

As one aspect of the present disclosure, there is provided a driving method for a pixel array including a plurality of actual pixel units. As shown in FIG. 1, the driving method includes the following steps stp1 to stp3.

Step stp1 includes amplifying an input image to obtain an intermediate image, wherein the input image includes a plurality of initial theoretical pixel units, the intermediate image includes a plurality of intermediate theoretical pixel units, and the number of the intermediate theoretical pixel units of the intermediate image matches the number of the actual pixel units in the pixel array.

Step stp2 includes calculating display parameters of each actual pixel unit based on display parameters of the intermediate theoretical pixel units of the intermediate image.

Step stp3 includes generating actual image signals based on the display parameters of each actual pixel unit calculated in step stp2 and inputting the actual image signals to the actual pixel units of the pixel array, respectively.

As described above, since the input image is amplified, the number of the initial theoretical pixel units in the input image is less than the number of the actual pixel units in the pixel array. Therefore, the amount of data of the input image is small, and by using the method provided in the present disclosure, the time required to transmit the data of the input image can be reduced in the case of a given data transmission speed, thus the input image can be quickly transmitted to a display device including the foregoing pixel array.

In the driving method provided by the present disclosure, since the input image is amplified, an intermediate image having a higher pixel resolution is obtained, and the image displayed in step stp3 also matches the intermediate image. Therefore, the pixel array driven by the method provided in the present disclosure may display images with high resolution.

There is no specific limitation on how to perform the step stp1 in the present disclosure, and a manner in which the input image is amplified may be determined based on the relationship between the resolution of the input image and the resolution of the pixel array. For example, as a specific embodiment, amplifying the input image in stp1 includes longitudinally amplifying the input image by a factor of two.

There are at least two types of standard for expressing display parameters of a pixel unit, one of which is to express display parameters of a pixel unit in an RGB space. In another standard, display parameters of a pixel unit are expressed in a YC space. Of course, display parameters of a pixel unit can also be expressed in other known color spaces.

When display parameters of a pixel unit are expressed in the RGB space, each pixel unit includes a red sub-pixel, a green sub-pixel, and a blue sub-pixel. Therefore, display parameters of the pixel unit include luminance of the red sub-pixel, luminance of the green sub-pixel and luminance of the blue sub-pixel.

When display parameters of a pixel unit are expressed in the YC space, display parameters of each pixel unit include lumen parameter Y, blue-difference chroma component Cb, and red-difference chroma component Cr.

Regardless of which one of the above mentioned standards is configured to express display parameters of a pixel unit, the following conditions are satisfied in the present disclosure:

display parameters of each initial theoretical pixel unit including a first initial display component, a second initial display component and a third initial display component, display parameters of each intermediate theoretical pixel unit including a first intermediate display component d, a second intermediate display component e and a third intermediate display component f.

Therefore, the process of amplifying the input image is performed in step stp1 according to the following equations;

$$d_{(2n-1)i}=\alpha D_{ni}+\beta D_{(n+1)i} \quad (1)$$

$$e_{(2n-1)i}=\alpha E_{ni}+\beta E_{(n+1)i} \quad (2)$$

$$f_{(2n-1)i}=\alpha F_{ni}+\beta F_{(n+1)i} \quad (3)$$

$$d_{(2n)i}=\eta D_{ni}+\gamma D_{(n+1)i} \quad (4)$$

$$e_{(2n)i}=\eta E_{ni}+\gamma E_{(n+1)i} \quad (5)$$

$$f_{(2n)i}=\eta F_{ni}+\gamma F_{(n+1)i} \quad (6)$$

wherein $d_{(2n-1)i}$ is a value of a first intermediate display component of the intermediate theoretical pixel unit in the (2n−1)-th row and the i-th column;

$e_{(2n-1)i}$ is a value of a second intermediate display component of the intermediate theoretical pixel unit in the (2n−1)-th row and the i-th column;

$f_{(2n-1)i}$ is a value of a third intermediate display component of the intermediate theoretical pixel unit in the (2n−1)-th row and the i-th column;

$d_{(2n)i}$ is a value of a first intermediate display component of the intermediate theoretical pixel unit in the 2n-th row and the i-th column;

$e_{(2n)i}$ is a value of a second intermediate display component of the intermediate theoretical pixel unit in the 2n-th row and the i-th column;

$f_{(2n)i}$ is a value of a third intermediate display component of the intermediate theoretical pixel unit in the 2n-th row and the i-th column;

$D_{ni}$ is a value of a first initial display component of the initial theoretical pixel unit in the n-th row and the i-th column;

$E_{ni}$ is a value of a second initial display component of the initial theoretical pixel unit in the n-th row and the i-th column;

$F_{ni}$ is a value of a third initial display component of the initial theoretical pixel unit in the n-th row and the i-th column;

$D_{(n+1)i}$ is a value of a first initial display component of the initial theoretical pixel unit in the (n+1)-th row and the i-th column;

$E_{(n+1)i}$ is a value of a second initial display component of the initial theoretical pixel unit in the (n+1)-th row and the i-th column;

$F_{(n+1)i}$ is a value of a third initial display component of the initial theoretical pixel unit in the (n+1)-th row and the i-th column;

α, β, η, γ are all adjustment coefficients, wherein $\alpha+\beta=1$, $\eta+\gamma=1$, $0\leqslant\alpha\leqslant1$, $0\leqslant\beta\leqslant1$, $0\leqslant\eta\leqslant1$, $0\leqslant\gamma\leqslant1$;

n is a natural number and $0<n<M-1$, M is the total number of rows of intermediate theoretical pixel units of the intermediate image.

Only display parameters of the intermediate theoretical pixel units from the first row to the third row from the bottom of the intermediate image can be obtained by equations (1) to (6), whereas display parameters of the last two rows of intermediate theoretical pixel units of the intermediate image cannot be obtained.

There is no specific limitation on how to determine display parameters of the last two rows of intermediate theoretical pixel units of an intermediate image. For example, display parameters of the last two rows of intermediate theoretical pixel units of the intermediate image may be set to be the same as those of the last two rows of initial theoretical pixel units in the input image.

As one optional embodiment, display parameters of the last two rows of intermediate theoretical pixel units of the intermediate image may be calculated according to the following equations:

$$d_{(2n-1)i}=\alpha D_{ni}+\beta D_{ni} \quad (7)$$

$$e_{(2n-1)i}=\alpha E_{ni}+\beta E_{ni} \quad (8)$$

$$f_{(2n-1)i}=\alpha F_{ni}+\beta F_{ni} \quad (9)$$

$$d_{(2n)i}=\eta D_{ni}+\gamma D_{ni} \quad (10)$$

$$e_{(2n)i}=\eta E_{ni}+\gamma E_{ni} \quad (11)$$

$$f_{(2n)i}=\eta F_{ni}+\gamma F_{ni} \quad (12)$$

wherein $n=M-1$, M.

Display parameters of each intermediate theoretical pixel unit of the intermediate image may be determined with equations (1) to (12).

It can be seen from the above description that when the process of amplifying the input image is performed, each row of intermediate theoretical pixel unit may be obtained from two rows of initial theoretical pixel unit. The three intermediate display components of each intermediate theoretical pixel unit of the intermediate image may be calculated according to equations (1) to (6), respectively, so as to ensure not only the input image being amplified, but also the information presented by the input image not being changed.

As one embodiment, the initial theoretical pixel unit includes a red initial theoretical sub-pixel, a green initial theoretical sub-pixel, and a blue initial theoretical sub-pixel, and the first initial display component includes a grayscale value of the red initial theoretical sub-pixel, the second initial display component includes a grayscale value of the green initial theoretical sub-pixel, and the third initial display component includes a grayscale value of the blue initial theoretical sub-pixel.

Correspondingly, the intermediate theoretical pixel unit includes a red intermediate theoretical sub-pixel, a green intermediate theoretical sub-pixel and a blue intermediate theoretical sub-pixel, and the first intermediate display component includes a gray-scale value of the red intermediate theoretical sub-pixel, and the second intermediate display component includes a gray value of the green intermediate theoretical sub-pixel, and the third intermediate display component includes a gray value of the blue intermediate theoretical sub-pixel.

Figure 2:
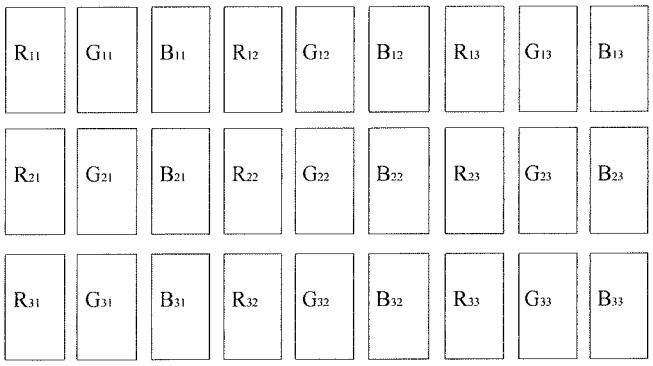
FIG. 2 is a schematic diagram of a portion of an input image.

FIG. 2 illustrates a portion of the input image, which includes nine initial theoretical pixel units in three rows and three columns, each initial theoretical pixel unit including three initial theoretical sub-pixels. Specifically, the initial theoretical pixel unit in the first row and the first column includes a red initial theoretical sub-pixel $R_{11}$, a green initial theoretical sub-pixel $G_{11}$, and a blue initial theoretical sub-pixel $B_{11}$; the initial theoretical pixel unit in the first row and the second column includes a red initial theoretical sub-pixel $R_{12}$, a green initial theoretical sub-pixel $G_{12}$, and a blue initial theoretical sub-pixel $B_{12}$; the initial theoretical pixel unit in the first row and the third column includes a red initial theoretical sub-pixel $R_{13}$, a green initial theoretical sub-pixel $G_{13}$, and a blue initial theoretical sub-pixel $B_{13}$. The color and serial number of each of the initial theoretical sub-pixels of the initial theoretical pixel units in each row and each column have been clearly shown in the figure, and will not be described one by one herein.

Figure 3:
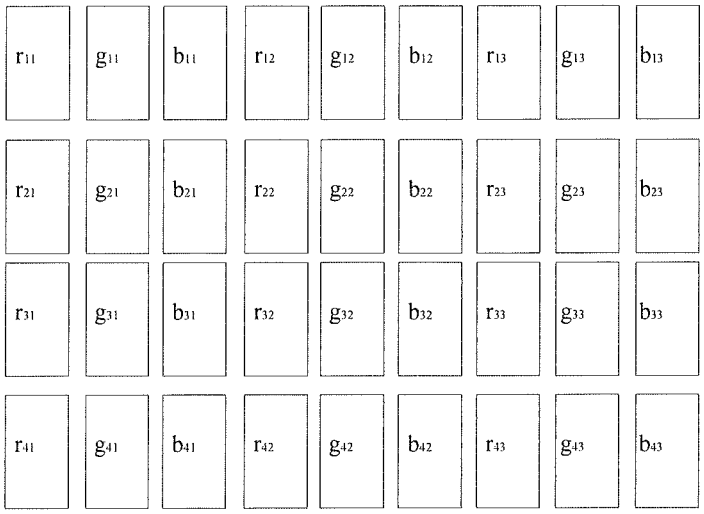
FIG. 3 is a schematic diagram of a portion of an intermediate image.

FIG. 3 illustrates a portion of the intermediate image, which includes twelve intermediate theoretical pixel units in four rows and three columns, each intermediate theoretical pixel unit including three intermediate theoretical sub-pixels. Specifically, the intermediate theoretical pixel unit in the first row and the first column includes a red intermediate theoretical sub-pixel $r_{11}$, a green intermediate theoretical sub-pixel $g_{11}$, and a blue intermediate theoretical sub-pixel $b_{11}$; the intermediate theoretical pixel unit in the first row and the second column includes a red intermediate theoretical sub-pixel $r_{12}$, a green intermediate theoretical sub-pixel $g_{12}$, and a blue intermediate theoretical sub-pixel $b_{12}$; the intermediate theoretical pixel unit in the first row and the third column includes a red intermediate theoretical sub-pixel $r_{13}$, a green intermediate theoretical sub-pixel $g_{13}$, and a blue intermediate theoretical sub-pixel $b_{13}$. The color and serial number of each of the intermediate theoretical sub-pixels of the intermediate theoretical pixel unit in each row and each column have been clearly shown in the figure, and will not be described one by one herein.

The grayscale values of each intermediate theoretical sub-pixel in the intermediate image are calculated based on equations (1) to (6) in the following.

The grayscale value of the red intermediate theoretical sub-pixel of the intermediate theoretical pixel unit in the first row and the first column can be calculated according to equation (1).

The first initial display component $D_{11}$ of the initial theoretical pixel unit in the first row and the first column is the grayscale value of the red initial theoretical sub-pixel of the initial theoretical pixel unit in the first row and first column, the second initial display component $E_{11}$ of the initial theoretical pixel unit in the first row and the first column is the grayscale value of the green initial theoretical sub-pixel of the initial theoretical pixel unit in the first row and first column, the third initial display component $F_{11}$ of the initial theoretical pixel unit in the first row and the first column is the grayscale value of the blue initial theoretical sub-pixel of the initial theoretical pixel unit in the first row and first column, The first intermediate display component $d_{11}$ of the intermediate theoretical pixel unit in the first row and the first column is the grayscale value of the red intermediate theoretical sub-pixel of the intermediate theoretical pixel unit in the first row and first column, the second intermediate display component $e_{11}$ of the intermediate theoretical pixel unit in the first row and the first column is the grayscale value of the green intermediate theoretical sub-pixel of the intermediate theoretical pixel unit in the first row and first column, the third intermediate display component $f_{11}$ of the intermediate theoretical pixel unit in the first row and the first column is the grayscale value of the blue intermediate theoretical sub-pixel of the intermediate theoretical pixel unit in the first row and first column.

Only a part of the input image is shown in FIG. 2, and therefore, display parameters of the intermediate theoretical pixel units of the part of intermediate image shown in FIG. 3 can be calculated according to equations (1) to (6).

The grayscale value $d_{11}$ of the red intermediate theoretical sub-pixel of the intermediate theoretical pixel unit in the first row and first column is $\alpha D_{11}+\beta D_{21}$, the grayscale value $e_{11}$ of the green intermediate theoretical sub-pixel of the intermediate theoretical pixel unit in the first row and first column is $\alpha E_{11}+\beta E_{21}$, the grayscale value $f_{11}$ of the blue intermediate theoretical sub-pixel of the intermediate theoretical pixel unit in the first row and first column is $\alpha F_{11}+\beta F_{21}$.

The grayscale value $d_{21}$ of the red intermediate theoretical sub-pixel of the intermediate theoretical pixel unit in the second row and first column is $\eta D_{11}+\gamma D_{21}$, the grayscale value $e_{21}$ of the green intermediate theoretical sub-pixel of the intermediate theoretical pixel unit in the second row and first column is $\eta E_{11}+\gamma E_{21}$, the grayscale value $f_{21}$ of the blue intermediate theoretical sub-pixel of the intermediate theoretical pixel unit in the second row and first column is $\eta F_{11}+\gamma F_{21}$.

By analogy, the greyscale value of each intermediate theoretical sub-pixel in the remaining intermediate theoretical pixel units can be calculated according to equations (1) to (6).

As described above, display parameters of pixel units may be expressed in the YC space. In this case, the first initial display component includes an initial lumen component of the initial theoretical pixel unit, the second initial display component includes an initial blue-difference chroma component of the initial theoretical pixel unit, and the third initial display component includes an initial red-difference chroma component of the initial theoretical pixel unit.

The first intermediate display component includes an intermediate lumen component of the intermediate theoretical pixel unit, the second intermediate display component includes an intermediate blue-difference chroma component of the intermediate theoretical pixel unit, and the third intermediate display component includes an intermediate red-difference chroma component of the intermediate theoretical pixel unit.

YC space parameters of each intermediate theoretical pixel unit of the intermediate image can be obtained using YC space parameters of each initial theoretical pixel unit of the input image. When the pixel array is driven to display, the YC space parameters of the intermediate theoretical pixel units may be converted into RGB space parameters to generate corresponding driving signals, so as to drive the pixel array to display.

When display parameters of pixel units are expressed in the YC space, step stp1 includes the following steps stp11 to stp13.

Step stp11 includes calculating the first initial display component, the second initial display component, and the third initial display component of each initial theoretical pixel unit in the input image.

Step stp12 includes calculating the first intermediate display component, the second intermediate display component, and the third intermediate display component of each intermediate theoretical pixel unit of the intermediate image based on the first initial display component, the second initial display component, and the third initial display component of each initial theoretical pixel unit.

Step stp13 includes calculating a grayscale value of a red intermediate theoretical sub-pixel of each intermediate theoretical pixel unit, a grayscale value of a green intermediate theoretical sub-pixel of each intermediate theoretical pixel unit, and a grayscale value of a blue intermediate theoretical sub-pixel of each intermediate theoretical pixel unit based on the first intermediate display component, the second intermediate display component and the third intermediate display component of each intermediate theoretical pixel unit.

In the present disclosure, a structure of the pixel array is not particularly limited, as long as the pixel array matches the intermediate image.

As one embodiment, the arrangement of the actual pixel units of the pixel array is the same as that of the intermediate theoretical pixel units of the intermediate image. Each actual pixel unit in the pixel array can be driven to display in a one-to-one correspondence manner.

In particular, an actual pixel unit includes a plurality of actual sub-pixels, the arrangement of the actual sub-pixels in the actual pixel unit is the same as that of the intermediate theoretical sub-pixels in the intermediate theoretical pixel unit. In addition, the arrangement of the plurality of actual pixel units in the pixel array is the same as that of the plurality of intermediate theoretical pixel units of the intermediate image.

Figure 4:
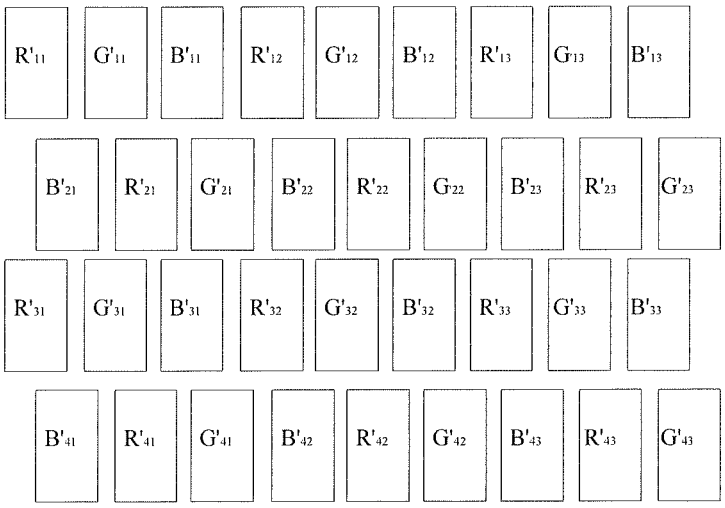
FIG. 4 is a schematic diagram of a portion of a pixel array.

In order to increase the visual resolution of the pixel array, a delta pixel arrangement may be adopted in the pixel array. As illustrated in FIG. 4, in the pixel array, the arrangement of the actual sub-pixels in one of the odd-numbered row of actual pixel units and the even-numbered row of actual pixel units is the same as that of the intermediate theoretical sub-pixels in the corresponding row of intermediate theoretical pixel units in the intermediate image, and the arrangement of the actual sub-pixels in one of the odd-numbered row of actual pixel units and the even-numbered row of actual pixel units is offset from the arrangement of the other one of the odd-numbered row of actual pixel units and the even-numbered row of actual pixel units by a predetermined distance along the row direction; the actual pixel units in the odd-numbered rows are aligned with each other, and the actual pixel units in the even-numbered rows are aligned with each other, the predetermined distance being a half of the width of each of the actual sub-pixels along the row direction.

As another embodiment, the arrangement of the actual pixel units in the pixel array is different from that of the intermediate theoretical pixel units of the intermediate image.

Through a rendering algorithm, the visual resolution of the image displayed by the display device including the pixel array can be higher than the resolution of the intermediate image and also higher than the actual resolution of the pixel array.

As one embodiment, each of the actual pixel units includes a red actual sub-pixel, a green actual sub-pixel, and a blue actual sub-pixel wherein display parameters of each of the actual pixel units includes a first actual display component, a second display component and a third display component. As shown in FIG. 4, the actual pixel unit in the first row and first column includes a red actual sub-pixel R'11, a green actual sub-pixel G'11, and a blue actual sub-pixel B'11. The actual sub-pixels of the remaining actual pixel units are shown in FIG. 4 and will not be described herein.

There is no specific limitation on how to implement the rendering algorithm. When the pixel array is the pixel array shown in FIG. 4, and when i<j<J, step stp2 may include the following steps stp21 to stp24.

Step stp21 includes taking display parameters of the odd-numbered row of intermediate theoretical pixel units in the intermediate image as display parameters of the odd-numbered row of actual pixel units in the pixel array.

Step stp22 includes calculating display parameters of the even-numbered row of actual pixel units according to the following equations:

$$D'_{aj}=[d_{(a-1)j}+d_{(a-1)(j+1)}]/2;$$

$$E'_{aj}=[e_{a(j-1)}+e_{aj}]/2;$$

$$F'_{aj}=[f_{a(j-1)}+f_{aj}]/2;$$

wherein $D'_{aj}$ is a first actual display component of the actual pixel unit in row a and column j;

$E'_{aj}$ is a second actual display component of the actual pixel unit in row a and column j;

$F'_{aj}$ is a third actual display component of the actual pixel unit in row a and column j;

$d_{(a-1)j}$ is a first intermediate display component of the intermediate theoretical pixel unit in row a−1 and column j;

$d_{(a-1)(j+1)}$ is a first intermediate display component of the intermediate theoretical pixel unit in row a−1 and column j+1;

$e_{a(j-1)}$ is a second intermediate display component of the intermediate theoretical pixel unit in row a and column j−1;

$e_{aj}$ is a second intermediate display component of the intermediate theoretical pixel unit in row a and column j;

$f_{a(j-1)}$ is a third intermediate display component of the intermediate theoretical pixel unit in row a and column j−1;

$f_{aj}$ is a third intermediate display component of the intermediate theoretical pixel unit in row a and column j;

a is an even number;

j is natural number, and 1<j<J, J is the number of actual pixel units in each row of actual pixel units.

As described in the above, since each of the intermediate theoretical pixel units includes a red intermediate theoretical sub-pixel, a green intermediate theoretical sub-pixel, and a blue intermediate theoretical sub-pixel, a first intermediate display component of the intermediate theoretical pixel unit is actually the grayscale value of the red intermediate theoretical sub-pixel, a second intermediate display component of the intermediate theoretical pixel unit is actually the grayscale value of the green intermediate theoretical sub-pixel, a third intermediate display component of the intermediate theoretical pixel unit is actually the grayscale value of the blue intermediate theoretical sub-pixel. Correspondingly, a first actual display component of each of the actual pixel units is actually the grayscale value of a red actual sub-pixel, a second actual display component of the actual pixel unit is actually the grayscale value of a green actual sub-pixel, a third actual display component of the actual pixel unit is actually the grayscale value of a blue actual sub-pixel.

When display parameters determined by the above method are configured to drive the pixel array to display, a higher visual resolution can be achieved.

For example, when the resolution of the input image is 2k×2k, the resolution of the intermediate image is 4k×2k, and a visual resolution of 4k×4k can be realized using the pixel array shown in FIG. 4.

The methods provided above do not define how to determine display parameters of actual pixel units at both ends (i.e., the first and last actual pixel units) of an even-numbered row of actual pixel units.

As an embodiment, display parameters of intermediate theoretical pixel units at both ends of an even-numbered row of intermediate pixel units of the intermediate image may be taken as actual display parameters of actual pixel units at both ends of the corresponding even-numbered row of actual pixel units in the pixel array, respectively.

Optionally, display parameters of actual pixel units at both ends of an even-numbered row of actual pixel units in the pixel array may be determined according to the following equations. That is, step stp2 may further include steps stp23 and stp24.

Step stp23 includes calculating display parameters of the first actual pixel unit of the even-numbered row according to the following equations:

$$D'_{a1}=[d_{(a-1)1}+d_{(a-1)2}]/2;$$

$$E'_{a1}=e_{a1};$$

$$F'_{a1}=[f_{(a-1)1}+f_{(a-1)2}]/2, \text{ wherein}$$

$D'_{a1}$ is a first actual display component of the actual pixel unit in row a and column 1, $E'_{a1}$ is a second actual display component of the actual pixel unit in row a and column 1, $F'_{a1}$ is a third actual display component of the actual pixel unit in row a and column 1, $d_{(a-1)1}$ is a first intermediate display component of the intermediate theoretical pixel unit in row a−1 and column 1, $d_{(a-1)2}$ is a first intermediate display component of the intermediate theoretical pixel unit in row a−1 and column 2, $e_{a1}$ is a second intermediate display component of the intermediate theoretical pixel unit in row a and column 1, $f_{(a-1)1}$ is a third intermediate display component of the intermediate theoretical pixel unit in row a−1 and column 1, and $f_{(a-1)2}$ is a third intermediate display component of the intermediate theoretical pixel unit in row a−1 and column 2.

Step stp24 includes calculating display parameters of the last actual pixel unit of the even-numbered row according to the following equation:

$$D'_{aJ}=d_{aJ};$$

$$E'_{aJ}=[e_{a(J-1)}+e_{aJ}]/2;$$

$$F'_{aJ}=f_{aJ}, \text{ wherein}$$

$D'_{aJ}$ is a first actual display component of the actual pixel unit in row a and column J, $E'_{aJ}$ is a second actual display component of the actual pixel unit in row a and column J, $F'_{aJ}$ is a third actual display component of the actual pixel unit in row a and column J, $d_{aJ}$ is a first intermediate display component of the intermediate theoretical pixel unit in row a and column J, $e_{(a-1)J}$ is a second intermediate display component of the intermediate theoretical pixel unit in row a−1 and column J, $e_{aJ}$ is a second intermediate display component of the intermediate theoretical pixel unit in row a and column J, $f_{aJ}$ is a third intermediate display component of the intermediate theoretical pixel unit in row a and column J, and J is the number of actual pixel units in each row of actual pixel units.

In the above, a driving method for displaying an image obtained by amplifying the input image longitudinally by a factor of two is described. However, it should be noted that the method of amplifying the input image is not limited to amplifying the input image longitudinally by a factor of two.

There is no particular requirement on a resolution of the input image in the present disclosure. For example, the input image may be an image with a resolution of 2k×2k. Correspondingly, the resolution of the intermediate image obtained after the input image is amplified by a factor of two in the vertical direction is 4k×2k.

For example, in step stp1, the input image is amplified by a factor of two in the vertical direction and amplified by a factor of two in the horizontal direction.

As a second aspect of the disclosure, there is provided a driving circuit for driving a pixel array using the above-described driving method provided by the present disclosure.

Figure 5:
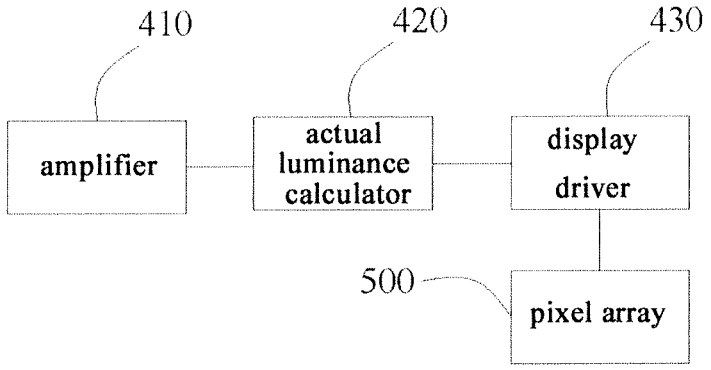
FIG. 5 is a schematic diagram of modules of a driving circuit provided in the present disclosure.
Figure 6:
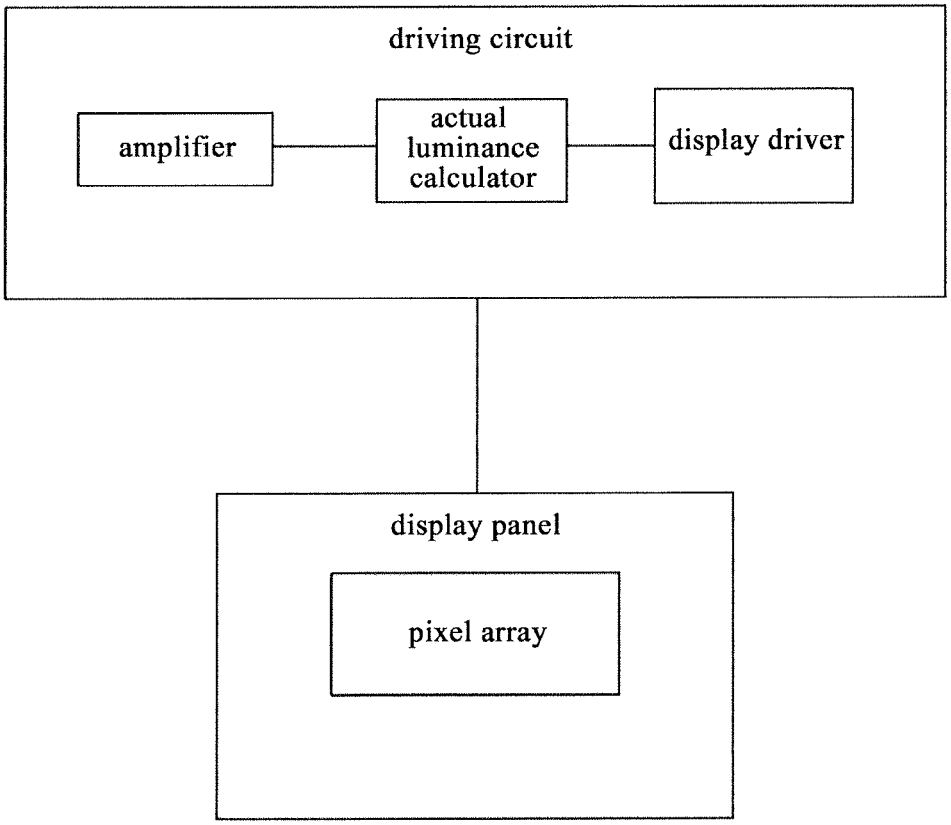
FIG. 6 shows a display device including a display panel and a driving circuit provided in the present disclosure.

In particular, as shown in FIG. 5, the driving circuit includes the following components.

An amplifier 410 configured to perform the step stp1, i.e., to amplify an input image to obtain an intermediate image, wherein the input image includes a plurality of initial theoretical pixel units, the intermediate image includes a plurality of intermediate theoretical pixel units, and the number of the intermediate theoretical pixel units of the intermediate image matches the number of the actual pixel units in a pixel array 500.

An actual luminance calculator 420 configured to perform the step stp2, i.e., to calculate display parameters of each actual pixel unit based on display parameters of the intermediate theoretical pixel units of the intermediate image.

A display driver 430 connected with an input terminal of the pixel array 500 and configured to perform the step stp3, i.e., to generate actual image signals based on the display parameters of each actual pixel unit calculated by the actual luminance calculator 420 and input the actual image signals to the actual pixel units of the pixel array 500, respectively.

When driving the pixel array to display an image, the driving circuit can drive a pixel array of high resolution by using an input image of low resolution. Moreover, since the amount of data included in the input image is small, the speed of data transmission can also be increased when the image is displayed.

As a third aspect of the present disclosure, there is provided a display device including a pixel array and a driving circuit for driving the pixel array, wherein the driving circuit is the above-described driving circuit provided by the present disclosure.

In the present disclosure, there is no particular limitation on a structure of the pixel array. For example, in one embodiment, the arrangement of actual pixel units of the pixel array may be the same as that of intermediate theoretical pixel units in the intermediate image.

In order to achieve a higher visual resolution, a delta pixel arrangement may be adopted in the pixel array. In particular, each of the actual pixel units includes a plurality of actual sub-pixels, and the number of the actual sub-pixels is the same as that of the intermediate theoretical sub-pixels in the intermediate image. In the pixel array, the arrangement of the actual sub-pixels in one of the odd-numbered row of actual pixel units and the even-numbered row of actual pixel units is the same as that of the intermediate theoretical sub-pixels in the corresponding row of intermediate theoretical pixel units in the intermediate image, and the arrangement of the actual sub-pixels in one of the odd-numbered row of actual pixel units and the even-numbered row of actual pixel units is offset from the arrangement of the other one of the odd-numbered row of actual pixel units and the even-numbered row of actual pixel units by a predetermined distance along the row direction; the actual pixel units in the odd-numbered rows are aligned with each other, and the actual pixel units in the even-numbered rows are aligned with each other, the predetermined distance being a half of the width of each of the actual sub-pixels along the row direction.

It could be understood that the above implementations are merely exemplary embodiments adopted for describing the principle of the present disclosure, but the present disclosure is not limited thereto. Various variations and improvements may be made by those of ordinary skill in the art without departing from the spirit and essence of the present disclosure, and these variations and improvements shall also fall into the protection scope of the present disclosure.

What is claimed is:

1. A driving method for a pixel array comprising a plurality of actual pixel units, the driving method comprising:

amplifying an input image to obtain an intermediate image, wherein the input image comprises a plurality of initial theoretical pixel units, the intermediate image comprises a plurality of intermediate theoretical pixel units, and a number of the intermediate theoretical pixel units of the intermediate image matches a number of the actual pixel units in the pixel array;

calculating display parameters of each actual pixel unit based on display parameters of the intermediate theoretical pixel units of the intermediate image; and generating actual image signals based on the calculated display parameters of each actual pixel unit and inputting the actual image signals to the actual pixel units of the pixel array, respectively, wherein amplifying the input image comprises longitudinally amplifying the input image by a factor of two; and wherein display parameters of each initial theoretical pixel unit comprises a first initial display component, a second initial display component and a third initial display component, display parameters of each intermediate theoretical pixel unit comprises a third intermediate display component, a second intermediate display component and a third intermediate display component when, $0<n<M-1$, the process of amplifying the input image is performed according to the following equations:

$$d_{(2n-1)i}=\alpha D_{ni}+\beta D_{(n+1)i};$$

$$e_{(2n-1)i}=\alpha E_{ni}+\beta E_{(n+1)i};$$

$$f_{(2n-1)i}=\alpha F_{ni}+\beta F_{(n+1)i};$$

$$d_{(2n)i}=\eta D_{ni}+\gamma D_{(n+1)i};$$

$$e_{(2n)i}=\eta E_{ni}+\gamma E_{(n+1)i};$$

$$f_{(2n)i}=\eta F_{ni}+\gamma F_{(n+1)i};$$

wherein $d_{(2n-1)i}$ is a value of a first intermediate display component of the intermediate theoretical pixel unit in row (2n−1) and column i;

$e_{(2n-1)i}$ is a value of a second intermediate display component of the intermediate theoretical pixel unit in row (2n−1) and column i;

$f_{(2n-1)i}$ is a value of a third intermediate display component of the intermediate theoretical pixel unit in row (2n−1) and column i;

$d_{(2n)i}$ is a value of a first intermediate display component of the intermediate theoretical pixel unit in row 2n and column i;

$e_{(2n)i}$ is a value of a second intermediate display component of the intermediate theoretical pixel unit in row 2n and column i;

$f_{(2n)i}$ is a value of a third intermediate display component of the intermediate theoretical pixel unit in row 2n and column i;

$D_{ni}$ is a value of a first initial display component of the initial theoretical pixel unit in row n and column i;

$E_{ni}$ is a value of a second initial display component of the initial theoretical pixel unit in row n and column i;

$F_{ni}$ is a value of a third initial display component of the initial theoretical pixel unit in row n and column i;

$D_{(n+1)i}$ is a value of a first initial display component of the initial theoretical pixel unit in row (n+1) and column i;

$E_{(n+1)i}$ is a value of a second initial display component of the initial theoretical pixel unit in row (n+1) and column i;

$F_{(n+1)i}$ is a value of a third initial display component of the initial theoretical pixel unit in row (n+1) and column i;

α, β, η, γ are all adjustment coefficients, wherein $\alpha+\beta=1$, $\eta+\gamma=1$, $0\leqslant\alpha\leqslant1$, $0\leqslant\beta\leqslant1$, $0\leqslant\eta\leqslant1$, $0\leqslant\gamma\leqslant1$;

n is a natural number; and

M is a total number of rows of intermediate theoretical pixel units of the intermediate image.

2. The driving method of claim 1, wherein when n=M−1, M, the process of amplifying the input image is performed according to the following equations;

$$d_{(2n-1)i}=\alpha D_{ni}+\beta D_{ni};$$

$$e_{(2n-1)i}=\alpha E_{ni}+\beta E_{ni};$$

$$f_{(2n-1)i}=\alpha F_{ni}+\beta F_{ni};$$

$$d_{(2n)i}=\eta D_{ni}+\gamma D_{ni};$$

$$e_{(2n)i}=\eta E_{ni}+\gamma E_{ni};$$

$$f_{(2n)i}=\eta F_{ni}+\gamma F_{ni}.$$

3. The driving method of claim 1, wherein display parameters of the last two rows of intermediate theoretical pixel units of the intermediate image are set to be the same as display parameters of the last two rows of initial theoretical pixel units in the input image.

4. The driving method of claim 1, wherein each of the initial theoretical pixel units comprises a red initial theoretical sub-pixel, a green initial theoretical sub-pixel, and a blue initial theoretical sub-pixel, and the first initial display component comprises a grayscale value of the red initial theoretical sub-pixel, the second initial display component comprises a grayscale value of the green initial theoretical sub-pixel, and the third initial display component comprises a grayscale value of the blue initial theoretical sub-pixel; and each of the intermediate theoretical pixel units comprises a red intermediate theoretical sub-pixel, a green intermediate theoretical sub-pixel and a blue intermediate theoretical sub-pixel, and the first intermediate display component comprises a gray-scale value of the red intermediate theoretical sub-pixel, and the second intermediate display component comprises a gray value of the green intermediate theoretical sub-pixel, and the third intermediate display component comprises a gray value of the blue intermediate theoretical sub-pixel.

5. The driving method of claim 1, wherein the first initial display component comprises an initial lumen component of each of the initial theoretical pixel units, the second initial display component comprises an initial blue-difference chroma component of the initial theoretical pixel unit, and the third initial display component comprises an initial red-difference chroma component of the initial theoretical pixel unit; and the first intermediate display component comprises an intermediate lumen component of each of the intermediate theoretical pixel units, the second intermediate display component comprises an intermediate blue-difference chroma component of the intermediate theoretical pixel unit, and the third intermediate display component comprises an intermediate red-difference chroma component of the intermediate theoretical pixel unit.

6. The driving method of claim 5, wherein amplifying the input image to obtain an intermediate image comprises:

calculating the first initial display component, the second initial display component, and the third initial display component of each initial theoretical pixel unit in the input image;

calculating the first intermediate display component, the second intermediate display component, and the third intermediate display component of each intermediate theoretical pixel unit of the intermediate image based on the first initial display component, the second initial display component, and the third initial display component of each initial theoretical pixel unit; and calculating a grayscale value of a red intermediate theoretical sub-pixel of each intermediate theoretical pixel unit, a grayscale value of a green intermediate theoretical sub-pixel of each intermediate theoretical pixel unit, and a grayscale value of a blue intermediate theoretical sub-pixel of each intermediate theoretical pixel unit based on the first intermediate display component, the second intermediate display component and the third intermediate display component of each intermediate theoretical pixel unit.

7. The driving method of claim 1, wherein an arrangement of the actual pixel units of the pixel array is the same as that of the intermediate theoretical pixel units of the intermediate image.

8. The driving method of claim 7, wherein the actual pixel units each comprise a plurality of actual sub-pixels, and a number of the actual sub-pixels is the same as that of the intermediate theoretical sub-pixels in the intermediate image, and in the pixel array, an arrangement of the actual sub-pixels in one of an odd-numbered row of actual pixel units and an even-numbered row of actual pixel units is the same as that of the intermediate theoretical sub-pixels in a corresponding row of intermediate theoretical pixel units in the intermediate image, and the arrangement of the actual sub-pixels in one of the odd-numbered row of actual pixel units and the even-numbered row of actual pixel units is offset from the arrangement of the other one of the odd-numbered row of actual pixel units and the even-numbered row of actual pixel units by a predetermined distance along a row direction, and the actual pixel units in the odd-numbered rows are aligned with each other, and the actual pixel units in the even-numbered rows are aligned with each other.

9. The driving method of claim 8, wherein the predetermined distance is a half of a width of each actual sub-pixel along the row direction.

10. The driving method of claim 8, wherein in the pixel array, each of the actual pixel units comprises a red actual sub-pixel, a green actual sub-pixel, and a blue actual sub-pixel, wherein display parameters of each of the actual pixel units includes a first actual display component, a second display component and a third display component;

the arrangement of the actual sub-pixels in the odd-numbered row of actual pixel units is the same as that of the intermediate theoretical sub-pixels in the corresponding row of intermediate theoretical pixel units in the intermediate image, and the actual sub-pixels in the odd-numbered row of actual pixel units are arranged in the order of a red actual sub-pixel, a green actual sub-pixel, and a blue actual sub-pixel;

the actual sub-pixels in the even-numbered row of actual pixel units are arranged in the order of a blue actual sub-pixel, a red actual sub-pixel, and a green actual sub-pixel;

when 1<j<J, calculating display parameters of each actual pixel unit based on display parameters of the intermediate theoretical pixel units of the intermediate image comprises:

taking display parameters of the odd-numbered row of intermediate theoretical pixel units in the intermediate image as display parameters of the odd-numbered row of actual pixel units in the pixel array;

calculating display parameters of the even-numbered row of actual pixel units according to the following equations:

$$D'_{aj}=[d_{(a-1)j}+d_{(a-1)(j+1)}]/2;$$

$$E'_{aj}=[e_{a(j-1)}+e_{aj}]/2;$$

$$F'_{aj}=[f_{a(j-1)}+f_{aj}]/2;$$

wherein $D'_{aj}$ is a first actual display component of the actual pixel unit in row a and column j;

$E'_{aj}$ is a second actual display component of the actual pixel unit in row a and column j;

$F'_{aj}$ is a third actual display component of the actual pixel unit in row a and column j;

$d_{(a-1)j}$ is a first display parameter of the intermediate theoretical sub-pixel in row a−1 and column j;

$d_{(a-1)(j-1)}$ is a first intermediate display component of the intermediate theoretical pixel unit in row a−1 and column j+1;

$e_{a(j-1)}$ is a second intermediate display component of the intermediate theoretical pixel unit in row a and column j−1;

$e_{aj}$ is a second intermediate display component of the intermediate theoretical pixel unit in row a and column j;

$f_{a(j-1)}$ is a third intermediate display component of the intermediate theoretical pixel unit in row a and column j−1;

$f_{aj}$ is a third intermediate display component of the intermediate theoretical pixel unit in row a and column j;

a is an even number; and j is natural number, and 1<j<J, J is a number of actual pixel units in each row of actual pixel units.

11. The driving method of claim 10, wherein calculating display parameters of each actual pixel unit based on display parameters of the intermediate theoretical pixel units of the intermediate image comprises:

calculating display parameters of the first actual pixel unit of the even-numbered row according to the following equations:

$$D'_{a1}=[d_{(a-1)1}+d_{(a-1)2}]/2;$$

$$E'_{a1}=e_{a1};$$

$$F'_{a1}=[f_{(a-1)1}+f_{(a-1)2}]/2;$$

$D'_{a1}$ is a first actual display component of the actual pixel unit in row a and column 1, $E'_{a1}$ is a second actual display component of the actual pixel unit in row a and column 1, $F'_{a1}$ is a third actual display component of the actual pixel unit in row a and column 1, $d_{(a-1)1}$ is a first intermediate display component of the intermediate theoretical pixel unit in row a−1 and column 1, $d_{(a-1)2}$ is a first intermediate display component of the intermediate theoretical pixel unit in row a−1 and column 2, $e_{a1}$ is a second intermediate display component of the intermediate theoretical pixel unit in row a and column 1, $f_{(a-1)1}$ is a third intermediate display component of the intermediate theoretical pixel unit in row a−1 and column 1, and $f_{(a-1)2}$ is a third intermediate display component of the intermediate theoretical pixel unit in row a−1 and column 2; and calculating display parameters of the last actual pixel unit of the even-numbered row according to the following equation:

$$D'_{aJ}=d_{aJ};$$

$$E'_{aJ}=[e_{a(J-1)}+e_{aJ}]/2;$$

$$F'_{aJ}=f_{aJ} \text{ wherein,}$$

$'_{aJ}$ is a first actual display component of the actual pixel unit in row a and column J, $E'_{aJ}$ is a second actual display component of the actual pixel unit in row a and column J, $F'_{aJ}$ is a third actual display component of the actual pixel unit in row a and column J, $d_{aJ}$ is a first intermediate display component of the intermediate theoretical pixel unit in row a and column J, $e_{(a-1)J}$ is a second intermediate display component of the intermediate theoretical pixel unit in row a−1 and column J, $e_{aJ}$ is a second intermediate display component of the intermediate theoretical pixel unit in row a and column J, and $f_{aJ}$ is a third intermediate display component of the intermediate theoretical pixel unit in row a and column J.

12. The driving method of claim 10, wherein calculating display parameters of each actual pixel unit based on display parameters of the intermediate theoretical pixel units of the intermediate image comprises: taking display parameters of the intermediate theoretical pixel units at both ends of the even-numbered row of the intermediate images as the actual display parameters of the actual pixel units at both ends of a corresponding even-numbered row in the pixel array.

13. The driving method of claim 1, wherein amplifying the input image comprises longitudinally amplifying the input image by a factor of two and horizontally amplifying the input image by a factor of two.

14. A driving circuit for driving a display panel, the display panel comprising a pixel array, the pixel array comprising a plurality of actual pixel units, each actual pixel unit comprising a plurality of actual sub-pixels of different colors, the driving circuit comprising:

an amplifier configured to amplify an input image to obtain an intermediate image, wherein the input image comprises a plurality of initial theoretical pixel units, the intermediate image comprises a plurality of intermediate theoretical pixel units, and a number of the intermediate theoretical pixel units of the intermediate image matches a number of the actual pixel units in the pixel array;

an actual luminance calculator configured to calculate display parameters of each actual pixel unit based on display parameters of the intermediate theoretical pixel units of the intermediate image; and a display driver connected with an input terminal of the pixel array and configured to generate actual image signals based on the display parameters of each actual pixel unit calculated by the actual luminance calculator and input the actual image signals to the actual pixel unit of the pixel array, respectively, wherein the amplifier is configured to longitudinally amplify the input image by a factor of two; and wherein display parameters of each initial theoretical pixel unit comprises a first initial display component, a second initial display component and a third initial display component, display parameters of each intermediate theoretical pixel unit comprises a first intermediate display component, a second intermediate display component and a third intermediate display component, when $0<n<M-1$, and the amplifier is configured to amplify the input image according to the following equations:

$$d_{(2n-1)i}=\alpha D_{ni}+\beta D_{(n+1)i};$$

$$e_{(2n-1)i}=\alpha E_{ni}+\beta E_{(n+1)i};$$

$$f_{(2n-1)i}=\alpha F_{ni}+\beta F_{(n+1)i};$$

$$d_{(2n)i}=\eta D_{ni}+\gamma D_{(n+1)i};$$

$$e_{(2n)i}=\eta E_{ni}+\gamma E_{(n+1)i};$$

$$f_{(2n)i}=\eta F_{ni}+\gamma F_{(n+1)i};$$

wherein $d_{(2n-1)i}$ is a value of a first intermediate display component of the intermediate theoretical pixel unit in row (2n−1) and column i;

$e_{(2n-1)i}$ is a value of a second intermediate display component of the intermediate theoretical pixel unit in row (2n−1) and column i;

$f_{(2n-1)i}$ is a value of a third intermediate display component of the intermediate theoretical pixel unit in row (2n−1) and column i;

$d_{(2n)i}$ is a value of a first intermediate display component of the intermediate theoretical pixel unit in row 2n and column i;

$e_{(2n)i}$ is a value of a second intermediate display component of the intermediate theoretical pixel unit in row 2n and column i;

$f_{(2n)i}$ is a value of a third intermediate display component of the intermediate theoretical pixel unit in row 2n and column i;

$D_{ni}$ is a value of a first initial display component of the initial theoretical pixel unit in row n and column i;

$E_{ni}$ is a value of a second initial display component of the initial theoretical pixel unit in row n and column i;

$F_{ni}$ is a value of a third initial display component of the initial theoretical pixel unit in row n and column i;

$D_{(n+1)i}$ is a value of a first initial display component of the initial theoretical pixel unit in row (n+1) and column i;

$E_{(n+1)i}$ is a value of a second initial display component of the initial theoretical pixel unit in row (n+1) and column i;

$F_{(n+1)i}$ is a value of a third initial display component of the initial theoretical pixel unit in row (n+1) and column i;

α, β, η, γ are all adjustment coefficients, wherein $\alpha+\beta=1$, $\eta+\gamma=1$, $0\leqslant\alpha\leqslant1$, $0\leqslant\beta\leqslant1$, $0\leqslant\eta\leqslant1$, $0\leqslant\gamma\leqslant1$;

n is a natural number; and

M is a total number of rows of intermediate theoretical pixel units of the intermediate image.

15. A display device comprising a display panel and a driving circuit, wherein the driving circuit is the driving circuit according to claim 14, the display panel comprises a pixel array, and the pixel array comprises a plurality of actual pixel units.

16. The display device of claim 15, wherein the actual pixel units each comprise a plurality of actual sub-pixels, and a number of the actual sub-pixels is the same as that of the intermediate theoretical sub-pixels in the intermediate image, and in the pixel array, an arrangement of the actual sub-pixels in one of an odd-numbered row of actual pixel units and an even-numbered row of actual pixel units is the same as that of the intermediate theoretical sub-pixels in a corresponding row of the intermediate theoretical pixel units in the intermediate image, and the arrangement of the actual sub-pixels in one of the odd-numbered row of actual pixel units and the even-numbered row of actual pixel units is offset from the arrangement of the other one of the odd-numbered row of actual pixel units and the even-numbered row of actual pixel units by a predetermined distance along a row direction, and the actual pixel units in the odd-numbered rows are aligned with each other, and the actual pixel units in the even-numbered rows are aligned with each other.

17. The display device of claim 16, wherein the predetermined distance is a half of a width of each actual sub-pixel along the row direction.

18. The display device of claim 16, wherein in the pixel array, each of the actual pixel units comprises a red actual sub-pixel, a green actual sub-pixel, and a blue actual sub-pixel;

the arrangement of the actual sub-pixels in the odd-numbered row of actual pixel units is the same as that of the intermediate theoretical sub-pixels in the corresponding row of intermediate theoretical pixel units in the intermediate image, and the actual sub-pixels in the odd-numbered row of actual pixel units are arranged in the order of a red actual sub-pixel, a green actual sub-pixel, and a blue actual sub-pixel; and the actual sub-pixels in the even-numbered row of actual pixel units are arranged in the order of a blue actual sub-pixel, a red actual sub-pixel, and a green actual sub-pixel.

* * * * *